United States Patent [19]

Dixon

[11] Patent Number: 4,720,406

[45] Date of Patent: Jan. 19, 1988

[54] ARTIST'S CANVAS AND PRODUCTION PROCESS THEREFOR

[76] Inventor: Harry E. Dixon, 9034 Cascade St., Beulah, Colo. 81023

[21] Appl. No.: 35,588

[22] Filed: Apr. 7, 1987

[51] Int. Cl.[4] ..... A47G 1/12

[52] U.S. Cl. ..... 428/14; 428/45; 428/205; 428/211; 428/343; 428/354; 428/497; 428/481; 428/499; 428/537.5; 428/479.6; 428/475.5; 428/16; 428/247; 428/252; 428/473

[58] Field of Search ..... 428/14, 45, 205, 211, 428/343, 354, 497, 481, 499, 537.5, 479.6, 475.5, 16, 247, 252, 473; 206/1.7; 434/8 H

[56] References Cited

U.S. PATENT DOCUMENTS 4,344,997 8/1982 Paquette ..... 428/14

*Primary Examiner*—Marion C. McCamish

*Assistant Examiner*—Cheryl L. Buczek

*Attorney, Agent, or Firm*—Timothy J. Martin

[57] ABSTRACT

A canvas for use by an artist for painting includes a flexible substrate material having a surface coating of a refined animal glue which forms a translucent glaze as the painting surface. The substrate is preferably open-weave nylon having a denier value of between 200 and 400 denier, inclusive. A binding intermediate coating of either rabbit skin glue or a whitener may be used to increase the binding of the surface coating to the substrate, and the coated substrate may be mounted on a stretching framework and, if desired, backed by butcher's paper. The production process for this canvas includes the steps of coating a sheet of the substrate with a binding material, drying this first coat, glazing the material with a glazing compound that dries to a translucent layer, and drying the glazed sheet. This process may be a continuous stream production process.

33 Claims, 4 Drawing Figures

ARTIST'S CANVAS AND PRODUCTION PROCESS THEREFOR

BACKGROUND OF THE INVENTION

The present invention is directed to an artist's canvas adapted to provide a surface upon which a artist may print. The artist's canvas according to the present invention further provides a new and useful canvas which not only offers the desirable characteristics of prior art canvasses but also improves upon existing canvasses with respect to strength and weight. Further, the present invention, by its composition, allows an artist to suggest the effect of three dimensional depth without requiring that the artist apply thick, heavy layers of paint. The present invention also encompasses the production method for such canvas.

Since the early beginnings of humankind, artists have sought to express their ideas and emotions through the painting medium. From its early roots in magic and ritual, through religious worship, through recordation of historical events and daily life to pure aesthetic decoration, artists have continually sought new, different and better substrates upon which to ply their talent. Indeed, almost any surface imaginable has, at one time or another, been used as a painting surface. Such surfaces include cave walls, other stone surface, paper, bone, animal skins and cloth materials, to name a few. Artists of the last several hundred years have predominantly relied upon man-made cloth canvasses as the main painting substrate; it is to this painting substrate that the present invention is directed.

Traditional artist's canvasses are formed of linen, cotton, polyester or cotton/polyester mix materials. These materials are selected to have roughness or "tooth" which describes the roughness of the textured surface of the canvas that receives the artist's brush stroke. The less expensive of these existing canvasses are formed by coating the substrate cloth material with an acrylic binder. The more expensive of these prior art canvasses first have a layer of rabbit skin glue as a binder and have an acrylic binder placed on top of the rabbit skin glue binder to form the painting surface. Examples of these canvasses are those sold by Grumbacher, Inc. of New York, N.Y., Fredrix Art Canvas of Lawrenceville, Kans. and Wolsey Co. of City of Industry, Calif.

These prior art canvasses are typically stretched in a taut condition across stretcher bars which form a framework around the perimeter of the canvas, with the canvas being fastened to the stretcher bars to maintain the canvas in the taut condition. Care must be taken when stretching the canvas, though, since the substrate material may become torn or the threads thereof may become separated where too much tension is placed on the material. For this reason, prior art canvasses are made if relatively heavy cloth material to provide sufficient strength.

These existing prior art canvasses have, in many applications, proved suitable as painting surfaces. However, an artist must be especially talented to achieve certain artistic affects on these canvasses. For example, to create a three dimensional appearance, an artist must apply thick layerings of paint in order to form high relief regions that physically give a three dimensional depth to the painting. Even where an artist accomplishes this three dimensional affect by layering different paint thicknesses, the three dimensional affect occurs at distances removed from the painting since the layering creates a more distorted picture when viewed from a close location.

Accordingly, there remains a need for an improved artist's canvas which provides not only the benefits of existing canvasses, but also additional enhancements over prior art canvasses. Such improved canvas must also be able to compete economically with existing canvasses so the pricing is within reach of most artists.

SUMMARY OF THE INVENTION

It is an object of the present invention to provide a new and useful artist's canvas which has increased strength and lighter weight.

It is a further object of the present invention to produce a competitively priced artist's canvas which provides an enhanced painting surface for producing a three dimensional effect.

It is yet another object of the present invention to provide a translucent artist's canvas which operates to provide an enhanced visual affect when used as a surface for painting.

A still further object of the present invention is to provide a canvas which has a painting surface into which paints defuse.

Yet another object of the present invention is to provide a method of production for an artist's canvas that has the enhanced qualities mentioned in the preceeding objects of this invention.

According to these objects, the present invention provides an artist canvas which has a surface upon which an artist may paint. The canvas includes a sheet of flexible substrate material upon which a surface coating is placed. This surface coating is formed of a refined animal glue which is adhered to the sheet of substrate material and is operative to form a translucent glaze thereon that becomes the surface to be painted. Preferably, an intermediate coating is provided between the sheet of substrate material and the surface coating such that the intermediate coating defines a binding to facilitate binding of the surface coating to the substrate material.

With greater particularity, the sheet of substrate material is preferably an open-weave cloth selected from a group consisting of nylon, silk and polyester which has a weave of between 200 and 800 denier, inclusive, in order to provide a tooth for the artist's canvas. The animal glue is selected from any suitable highly refined commerical white animal glue such as is readily available in the industry. The intermediate coating, in one embodiment, is formed of a high grade rabbit skin glue. In a second embodiment, the intermediate coating is formed of a whitener, such as flat latex paint. In any event, the coated substrate material may be stretched in a taut condition over a framework. If desired, the coated substrate sheet may be backed by a backing layer which is preferably a sheet of white butcher paper.

The process according to the present invention, then, includes the steps of first coating a clean substrate sheet of flexible material with a flexible binding material in order to form an intermediate processing sheet. Second, the intermediate processed sheet is dried after which it is glazed on at least one side thereof with a liquid glazing compound that dries as a translucent layer to form the surface to be painted upon by the painter. Finally, the glazed intermediate sheet is dried to form the final canvas.

This process may be carried on as a continuous production process and may include the step of cutting the sheet into selectively sized canvasses after the glazed intermediate processing sheet is dried. These canvasses may then be stretched onto selectively sized frames and fastened in a taut condition. Since the process contemplates the use of a clean substrate material, an initial cleaning step may need to be implemented. Further, the glazing compound may be a refined water-based animal glue which, at ambient temperatures of approximately 72° F., should be mixed in approximately equal proportions with water. This proportion of water to the animal glue may be increased in the processing step as a function of increasing ambient temperature. Further, in the preferred process, the substrate material is an open-weave nylon and the binding material is selected to be rabbit skin glue which is applied on the substrate material at a temperature of between 120° F. and 150° F. Alternately, the binding material may be a white water-based paint.

These and other objects of the present invention will become more readily appreciated and understood from a consideration of the following detailed description of the preferred embodiment when taken together with the accompanying drawings, to which:

DETAILED DESCRIPTION OF THE PREFERRED EMBODIMENT

The present invention is directed to an artist's canvas and a production process therefor which artist's canvas is both new and useful in the art industry. Particularly, the present invention contemplates the use of different substrate materials than those traditionally used for artist's canvas so as to increase the strength and weight of the canvas. In addition, different surface and intermediate coatings are employed not only to compliment the characteristics of the substrate material but also to enhance the visual affects which may be created by the artist when the canvas is used, with the canvas especially adapted to form a translucent painting surface into which paint may diffuse resulting in a depth of image or three dimensional affect.

Figure 1:
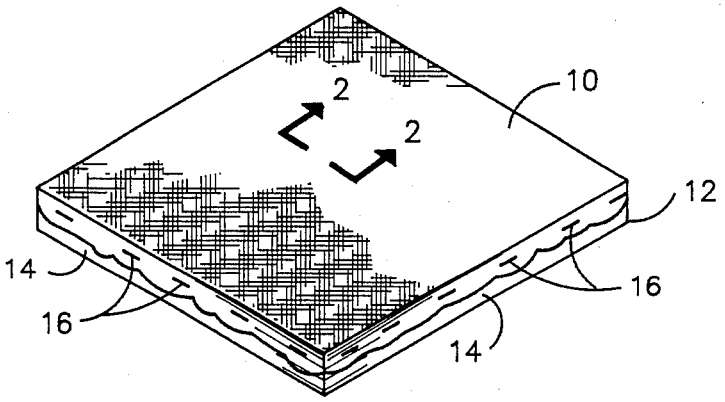
FIG. 1 is a perspective view of the artist's canvas according to the preferred embodiment of the present invention mounted on a stretching frame.

As may be seen in FIG. 1, an artist's canvas 10 is shown stretched on a framework 12 which comprises stretcher bars, such as stretcher bars 14. Canvas 10 is fastened around its perimeter in any suitable means, such as staples 16 so that canvas 10 is maintained in a taut condition on framework 12. Framework 12 may take any desired geometrical shape, according to the taste of the artist.

Figure 2:
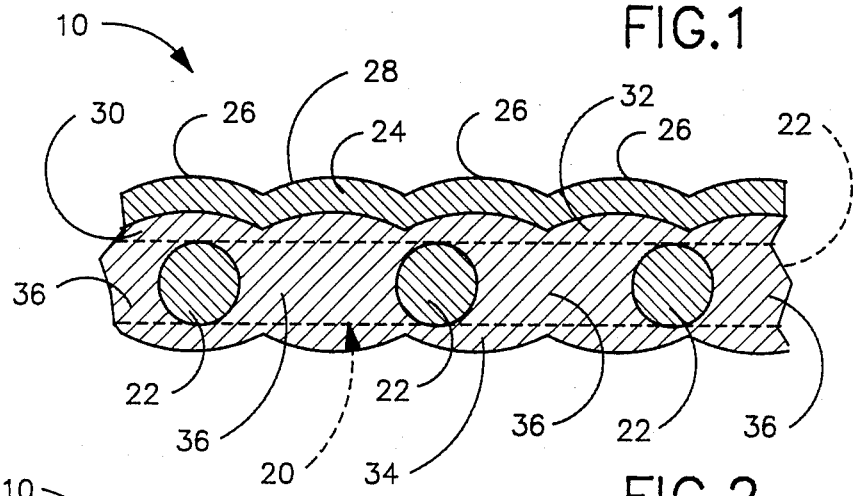
FIG. 2 is a cross-sectional view taken about lines 2—2 of FIG. 1.

The construction of a first embodiment canvas 10 is shown in greater detail in FIG. 2. Here, it should be appreciated that canvas 10 is formed by a substrate sheet 20 which is preferably an open-weave material formed as a plurality of threads, such as threads 22, which run at right angles to one another. In the preferred form of the present invention, open-weave substrate sheet 20 has a weave that produces a fineness having a denier value greater than or equal to 200 denier. As is known in the art, the greater the denier value, the coarser the fabric. The preferable range for the denier value for the present invention is 200 to 800 denier, inclusive, with best results having been experimentally achieved with substrates having approximately a denier of 400. This open-weave provides a tooth for the canvas. Substrate sheet 20 is preferably formed of a substrate material selected from a group consisting of nylon, polyester and silk. Also, it is best that no contaminant materials, such as oil, dirt, chemical repellant and the like, be present on the substrate where such materials could act as water repellants.

A surface coating 24 is placed over the substrate material and, because of the open-weave of substrate 20, a plurality of ungulations 26 are created to form the tooth of the canvas. Thus, surface coating 24 has an upper surface 28 that defines the surface upon which an artist paints. Surface coating 24 is a refined animal glue which is of any general, commerical available manufacture. For example, one suitable glue is that sold under the name Elmer's Glue All by Borden, Inc. of Columbus, Ohio, U.S.A. Other suitable animal glues are those sold by the Hyde Glue Co. of Indianapolis, Indiana, Elixir Industry of Gardenia, Calif. and Ross Industry of Detroit, Mich. Accordingly, what is meant in this application by "animal glue" are those glues comparable to Elmer's Glue-All which are commercially available. Elmer's Glue-All has advantages in that it is highly refined and dried to a translucent appearance.

In order to facilitate the binding of surface coating 24 to substrate 20, an intermediate binding coating 30 is formed on substrate 20 between substrate 20 and surface coating 24. As is seen in FIG. 2, intermediate coating 30 impregnates substrate 20 by having first and second surface portions 32 and 34 on opposite sides of substrate 20 with central portions 36 penetrating the regions between threads 22 so as to impregnate substrate 20. In the embodiment shown in FIG. 2, intermediate coating 30 is formed of a whitener, such as a white, water-based paint. This whitener enhances the bonding of surface coating 24 onto substrate 20 so that surface coating 24, when dried, forms a translucent glaze on at least one side of canvas 10. It should be appreciated, however, that a surface coating 24 may be placed on both sides of canvas 10 so that canvas 10 will have a flip symmetry, that is, so that it does not have a different upper and lower surface. It should also be appreciated that a high quality painting surface may be produced by forming a single layer of a mixed compound of the whitener and the animal glue, but this technique does not provide all of the benefits of the separately layered structure.

Figure 3:
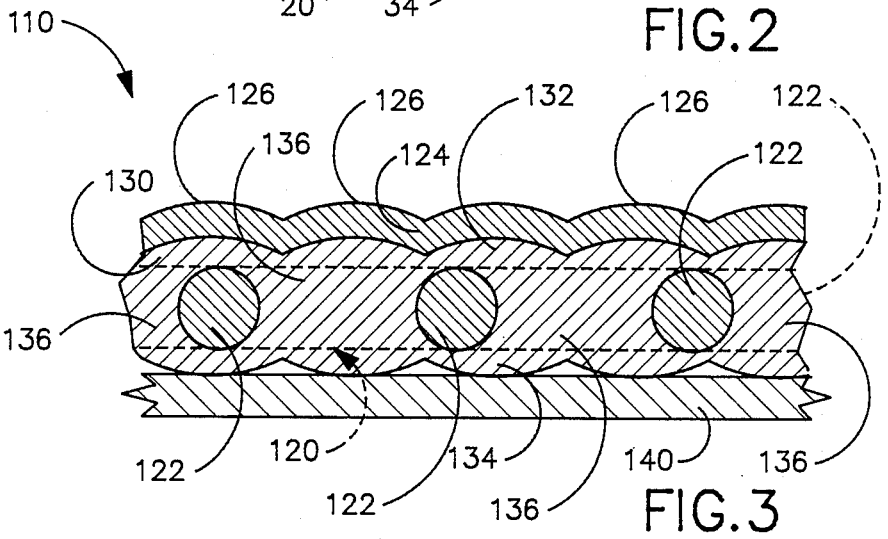
FIG. 3 is an alternate embodiment of the present invention shown in a similar cross-section to that shown in FIG. 2.

An alternate embodiment of the present invention is shown in FIG. 3. Here, substrate 120 may be an open-weave material preferably having between 45 and 55 threads per inch (approximately 400 denier) and again selected from a group consisting of nylon, polyester and silk. Preferably, substrate material 120 is nylon and is coated on both sides and impregnated by means of an intermediate coating 130 which is formed of a rabbit skin glue. Thus, substrate 120 has a first surface 132 and a second surface 134 which are interconnected by impregnating central portions 136 which extend through the regions formed by threads 122. A surface coating 124 is then formed on at least one side of substrate 120 and, since intermediate coating 130 assumes ungulations as a result of threads 122, surface coating 124 likewise has ungulantions 126 that form a tooth for canvas 110. Again, surface coating 124 is formed of a commerical, highly refined animal glue, and it is best that substrate 120 be cleaned of any water repellant materials.

Instead of using a whitener material for intermediate binding coating 130, in the embodiment shown in FIG. 3, coating 130, as noted above, is formed of a rabbit skin glue of a type that is again commerically available. Rabbit skin glue is highly desirable since it stays flexible and does not crack. Such rabbit skin glues are available and sold by LiquidTex and by Grumbacher. This rabbit skin glue dries clear so that it is desirable to provide a white matte surface behind the coated substrate sheet. Thus, the entire coated substrate is translucent. As is shown in FIG. 3, canvas 110, when mounted, preferably includes an independent white backing layer on a side of the sheet opposite the surface coating. Thus, layer 140 is provided and may preferably be formed by a sheet of white butcher paper or any other suitable backing material formed of any other suitable opaque material, which is preferably white. If desired, the backing may be formed as a coating of whitener on the second side of the substrate opposite the surface coating although this does not yield all of the desirable optical characteristics as the butcher paper backing.

As noted above, it is preferred that both substrates 20 and 120 be either nylon, polyester or silk. Of these, the preferable material is nylon due to its strength and cost. It has been found that for a nylon substrate, a canvas will have between three and four times the strength of commerically available canvasses at approximately half the weight. Further, since nylon is relatively inexpensive, canvasses formed according to the present invention are comparable in cost to existing canvasses. Nylon is further desirable since it is believed to absorb both the whitener and the rabbit skin glue to increase the binding effect. Furthermore, the use of animal glue for the surface coating which defines a surface upon which the artist places his/her paint provides a translucent surface that diffuses the paint pigments into body of the canvas. Furthermore, since the surface coating is translucent and is backed by a white material, the layer of translucent material gives the appearance of depth to the artwork so that a three dimensional affect is readily obtained.

It can thus be appreciated that the embodiment shown in FIG. 3 allows the creation of a greater three dimensional effect since surface coating 124 is translucent and intermediate coating 130 is transparent. Hence, a greater light transmissive mass is presented which permits greater parallax than that presented by the embodiment shown in FIG. 2. In FIG. 2, it is only the thickness of the translucent glaze formed by surface coating 24 that provides a light-transmissive body to create the three dimensional affect.

From the foregoing, it may be understood that the method according to the preferred embodiment of the present invention contemplates the formation of an artist's canvas such as described with respect to both FIGS. 2 and 3. Thus, the process according to the preferred embodiment of the present invention includes the steps of: (1) coating a substrate sheet of flexible substrate material with a flexible binding material to form an intermediate processing sheet; (2) drying said coated sheet; (3) glazing at least one side of said intermediate processing sheet with a liquid glazing compound that dries as a translucent layer to form the surface to be painted upon by the artist; and (4) drying said glaze said intermediate processing sheet. Preferably, this process is conducted as a continuous steam production process and includes a final step of cutting the glazed intermediate processing sheet into selectively sized canvasses. These canvasses are then stretched onto selectively sized frames and fastened in a taut condition.

Preferably, in the preferred process, the glazing compound is an animal glue which is even further preferred to be a commerical grade, highly refined animal glue. At room temperatures, the preferred method contemplates the mixing of this animal glue with equal proportions of water so that the resulting glue mixture is thinned so it may be applied as a relatively thin layer. Should ambient temperatures increase during the processing, the process includes the step of increasing the proportion of water to the animal glue as a function of increasing ambient temperature.

Further, it is preferred in the present process that the substrate sheet be an open-weave nylon and that the binding material either be a white, water-based paint or a rabbit skin glue. In the event that the selected binding material is rabbit skin glue, the coating step is conducted at a preferred temperature between 120° F. and 150° F., inclusive. If desired, the process can be carried out by mixing a whitener and animal glue and applying the mixed compound on the substrate in a single step. While this reduces the processing stages, the resultant canvas, while suitable for use, does not have all of the desired characteristics of those produced by the preferred method.

Figure 4:
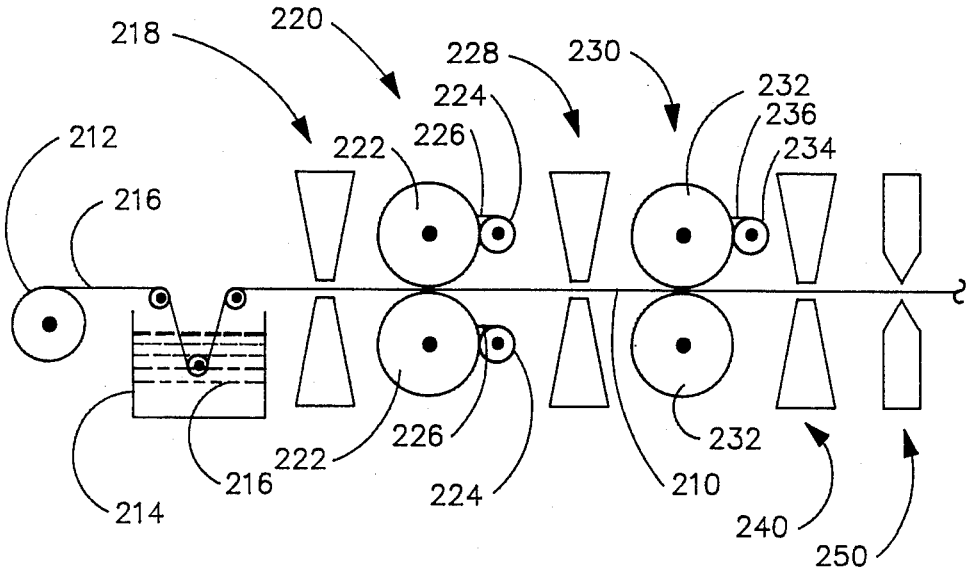
FIG. 4 is a diagrametric view showing a representative apparatus to accomplish the production of the artist's canvas according to both embodiments of the present invention.

Accordingly, a representative apparatus, in diagramatic form, to conduct the present process is shown in FIG. 4. Here, substrate material 210 is shown as a continuous stream of material feeding off of roller 212. Sheet 210 is conveyed through a vat 214 which contains a cleaning material 216 so that substrate 210 is first cleaned of water repellant substances, such as oil, dirt, and chemical repellants. The substrate is then passed through a first drier 218 before being presented to binder applying assembly 220. Assembly 220 includes a pair of platen rollers 222 each provided with a binder supply roller 224 with a reservoir of binder material 226 is provided between each roller 224 and its corresponding roller 222. After passing through binder applying assembly 220, sheet 210 passes through a second drier 228 and then between a surface coating applying apparatus 230 comprising a pair of platen rollers 232 and a surface coating supply roller 234 that provides a reservoir of surface coating material 236. The coated substrate then passes through a third drier 240 and then through a cutting machine 250 so that sheet 210 is cut into desired sections.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive conncepts contained herein.

I claim:

1. An artist's canvas forming a surface adapted to be painted, comprising a sheet of flexible, substrate material and a surface coating of refined animal glue adhered to said sheet of substrate material and operative to form a translucent glaze thereon to define the surface to be painted.

2. An artist's canvas according to claim 1 wherein said sheet of substrate material is woven with an open weave to form a tooth for said canvas.

3. An artist's canvas according to claim 1 wherein said substrate material is selected from a group consisting of nylon, polyester and silk.

4. An artist's canvas according to claim 3 wherein said sheet of substrate material has a denier value equal to or greater than 200 denier.

5. An artist's canvas according to claim 4 wherein said sheet of substrate material has a weave between 200 and 800 denier, inclusive.

6. An artist's canvas according to claim 3 wherein said substrate material is an open-weave having between 45 and 55 threads per inch.

7. An artist's canvas according to claim 1 including an intermediate coating between said sheet of substrate material and said surface coating, said intermediate coating defining a binding means for enhancing the binding of said surface coating to said sheet of substrate material.

8. An artist's canvas according to claim 7 wherein said intermediate coating is formed of rabbit skin glue.

9. An artist's canvas according to claim 8 including a backing layer on a side of said sheet of substrate material opposite said surface coating, said backing layer formed of an opaque, white material.

10. An artist's canvas according to claim 9 wherein said backing layer is a sheet of butcher paper.

11. An artist's canvas according to claim 7 wherein said intermediate coating is a whitener.

12. An artist's canvas according to claim 11 wherein said whitener is a white, water-based paint.

13. An artist's canvas according to claim 1 including a whitener material intermixed with said animal glue in said surface coating.

14. An artist's canvas having a surface upon which an artist may paint, comprising:

a flexible substrate sheet of open-weave nylon having a weave with a denier value equal to or greater than 200 denier;

a layer of whitener impregnating said substrate sheet and defining an intermediate coating on at least a first side thereof; and a surface coating of refined, water based animal glue on said layer on the first side of said substrate sheet, said layer operative as a binding for the substrate sheet and said surface coating, said surface coating forming a translucent glaze on said substrate sheet to define the surface to be painted.

15. An artist's canvas according to claim 14 wherein said substrate sheet has a weave with a denier value of between 200 and 800 denier, inclusive.

16. An artist's canvas according to claim 14 wherein said layer is a water-based white paint.

17. An artist's canvas according to claim 14 including a frame, said substrate sheet being stretched across said frame and fastened such that said substrate sheet is maintained in a taut condition.

18. An artist's canvas having a surface upon which an artist may paint, comprising:

a flexible substrate sheet of open-weave substrate material, establishing a tooth for said canvas;

a layer of rabbit skin glue impregnating said substrate sheet and defining an intermediate coating on at least a first side thereof; and a surface coating of refined water-based animal glue on said layer on the first side of said substrate sheet, said layer operative as a binding for the substrate sheet and said surface coating, said surface coating forming a translucent glaze on said substrate sheet to define the surface to be painted.

19. An artist's canvas according to claim 18 wherein said substrate material is selected to at least partially absorb the rabbit skin glue.

20. An artist's canvas according to claim 18 wherein said substrate material is selected from a group consisting of nylon, silk and polyester.

21. An artist's canvas according to claim 20 wherein said substrate material is nylon.

22. An artist's canvas according to claim 20 wherein said substrate sheet has between 45 and 55 threads per inch, inclusive.

23. An artist's canvas according to claim 18 including a backing sheet of opaque white paper on a second side of said substrate sheet opposite said first side.

24. An artist's canvas according to claim 23 including a frame, said substrate sheet being stretched across said frame and fasted such that said substrate sheet is maintained in a taut condition, said backing sheet located between the substrate sheet and said frame.

25. A process of forming an artist's canvas having a surface that may be painted, comprising the steps of:

coating a substrate sheet of flexible substrate material with a flexible binding material to form an intermediate processing sheet;

drying said coated sheet;

glazing at least one side of said intermediate processing sheet with a liquid glazing compound that dries as a translucent layer to form the surface to be painted by the artist wherein said glazing compound is refined water-based animal glue; and drying said glazed intermediate processing sheet.

26. The process according to claim 25 wherein said steps of coating, drying the coated sheet, glazing, and drying the glazed intermediate processing sheet are carried out by a continuous stream process, and including a step of cutting said glazed intermediate processing sheet into selectively sized canvasses.

27. The process according to claim 25 including the steps of stretching said canvasses onto respectively sized frames and fastening each canvas thereon in a taut condition.

28. The process according to claim 25 wherein said substrate sheet is an open weave nylon, said binding material being a white water-based paint.

29. The process according to claim 25 wherein said substrate sheet is an open weave nylon and said binding material is rabbit skin glue, the coating step being conducted at a temperature between 120° F. and 150° F.

30. The process according to claim 25 wherein said animal glue is a commercial grade glue mixed in approximate equal proportions with water where the glazing step is conducted at an ambient temperature of 72° F.

31. The process according to claim 30 including the step of increasing the proportion of water to the animal glue as a function of increasing ambient temperature.

32. A process of forming an artist's canvas having a surface that may be painted, comprising the steps of coating a clear substrate sheet of material with an admixture of whitener and refined animal glue to form a glazing thereon and drying the coated substrate sheet.

33. The process according to claim 32 wherein the substrate sheet is nylon and the whitener is a water-based paint.

* * * * *